US010051943B2

(12) United States Patent
Choi

(10) Patent No.: US 10,051,943 B2
(45) Date of Patent: Aug. 21, 2018

(54) ANTIBIOTIC MASCARA VESSEL HAVING DOOR FUNCTION

(71) Applicant: DMCOSMETICS Co., Ltd., Incheon (KR)

(72) Inventor: Minchel Choi, Incheon (KR)

(73) Assignee: DMCOSMETICS CO., LTD., Incheon (KR)

( * ) Notice: Subject to any disclaimer, the term of this patent is extended or adjusted under 35 U.S.C. 154(b) by 0 days.

(21) Appl. No.: 15/246,570

(22) Filed: Aug. 25, 2016

(65) Prior Publication Data

US 2017/0055678 A1 Mar. 2, 2017

(30) Foreign Application Priority Data

Aug. 25, 2015 (KR) ..... 10-2015-0119248

(51) Int. Cl.

| | |
|---|---|
| ***A46B 17/08*** | (2006.01) |
| ***A45D 40/26*** | (2006.01) |
| ***A45D 34/04*** | (2006.01) |
| ***A46B 9/02*** | (2006.01) |

(52) U.S. Cl.

CPC ..... *A45D 40/265* (2013.01); *A45D 34/046* (2013.01); *A45D 40/264* (2013.01); *A46B 9/021* (2013.01)

(58) Field of Classification Search

CPC ..... A45D 40/267

USPC ..... 401/122

See application file for complete search history.

(56) References Cited

U.S. PATENT DOCUMENTS

| | | | | |
|---|---|---|---|---|
| 2003/0200980 | A1 | 10/2003 | Le Gassie | |
| 2008/0276955 | A1* | 11/2008 | Neuner | A45D 40/262 132/218 |
| 2012/0170961 | A1* | 7/2012 | Bouix | A45D 40/0087 401/1 |
| 2017/0013940 | A1* | 1/2017 | Harry | A45D 40/24 |
| 2017/0265620 | A1* | 9/2017 | Bouix | A45D 40/18 |

FOREIGN PATENT DOCUMENTS

| | | |
|---|---|---|
| KR | 10-1289533 | 7/2013 |
| KR | 10-1386308 | 4/2014 |
| WO | 2011087124 A1 | 7/2011 |

* cited by examiner

*Primary Examiner* — Lori Baker

(74) *Attorney, Agent, or Firm* — Maschoff Brennan

(57) ABSTRACT

A mascara vessel having a door function includes: a vessel body; a packing set in the vessel body; a door hinged to the packing configured to close a passage of the packing; an elastic member provided on a hinge joint between the packing and the door, with opposite ends of the elastic member being held by the packing and the door, respectively, so that the elastic member elastically biases the door in a direction toward the packing; and a depression resisting member provided on the door to prevent the brush from being depressed by the door when the brush is pulled out of the vessel body, thus inhibiting the growth of microorganism.

6 Claims, 11 Drawing Sheets

ANTIBIOTIC MASCARA VESSEL HAVING DOOR FUNCTION

RELATED APPLICATION

This application claims the benefit of priority of Korean Patent Application No. 2015-0119248 filed Aug. 25, 2015, the contents of which are incorporated herein by reference in their entirety.

FIELD AND BACKGROUND OF THE INVENTION

The present invention generally relates to an antibiotic mascara vessel having a door function. More particularly, the present invention relates to a mascara vessel having a door function that is configured such that when a brush integrated with a cap and covered with mascara is pulled out of a vessel body, the mascara on the brush is evenly wiped with a packing set in the vessel body to remove excess mascara and thereby the present invention can provide the brush evenly covered with mascara to a user, wherein the antibiotic mascara vessel has an antimicrobial agent, thus inhibiting the growth of microorganism.

Generally, mascara is a substance used as a cosmetic to color the eyelashes so as to make the eyelashes look dark and long. Mascara is typically contained in a specific vessel and is typically applied to the eyelashes using a brush covered with the mascara.

An example of conventional mascara vessels may be referred to Korean Patent No. 10-1289533 entitled "mascara vessel having door function", which was filed by and allowed to the inventor of the present invention.

FIGS. 1 and 2 are views showing an example of conventional mascara vessels.

As shown in FIGS. 1 and 2, the conventional mascara vessel includes: a vessel body 1 that contains a predetermined amount of mascara therein and is open at only one end to form a mouth; a packing 3 set in the open mouth of the vessel body 1; and a cap 2 openably tightened to the open mouth of the vessel body 1 while passing through the packing 3.

Here, the cap 2 includes: a brush bar 2*a* integrated with an end of the cap 2; and a brush 2*b* that is provided on a lower end of the brush bar 2*a* and is covered with mascara contained in the vessel body 1.

The conventional mascara vessel further includes: a door 4 that is hinged to the packing 3 and comes into inclined contact with the packing 3, thereby closing a passage 3*a* of the packing 3; an elastic member 4*d* mounted to a hinge joint 4*a* of the packing 3 and the door 4 such that opposite ends of the elastic member 4*a* are supported by the packing 3 and the door 4, respectively, so that the elastic member 4*d* can elastically bias the door 4 in a direction toward the packing 3; and a protrusion 4*c* that protrudes on the door 4 and supports an end of the elastic member 4*d*, thereby minimizing the rotational angle of the elastic member 4*d*.

When it is desired to apply mascara to eyelashes using the conventional mascara vessel having the above-mentioned construction, the cap 2 is removed from the vessel body 1. When removing the cap 2 from the vessel body 1, the brush bar 2*a* having the brush 2*b* is pulled out of the vessel body 1 along with the cap 2. In this case, just after the brush 2*b* provided on the lower end of the brush bar 2*a* enters into the passage 3*a* of the packing 3, the door 4 is elastically rotated clockwise due to the elasticity of the elastic member 4*d* and comes into contact with an inclined surface 3*b* of the lower end of the packing 3, and an insert protrusion 4*b* provided on the upper surface of the door 4 is inserted into the passage 3*a* via an opening of the inclined surface 3*b* of the packing 3, thereby closing the passage 3*a* of the packing 3. Accordingly, the above-mentioned conventional mascara vessel is advantageous in that it is possible to minimize the contact between air and mascara contained in the vessel body 1 even when applying mascara, thereby solving the problem of hardening or deterioration of mascara contained in the vessel body and lengthening the life span of mascara.

However, the conventional mascara vessel is problematic in that when the brush bar 2*a* having the brush 2*b* is pulled out of the vessel body 10 along with the cap 2, the door 4 elastically biased by the elastic member 4*d* presses the brush 2*b* so that mascara that covers a part of the brush 2*b* which is in contact with the door 4 is totally wiped from the brush.

Moreover, when the user coats a mascara pigment on his eyebrows, the brush may be contaminated with microorganism, and as the brush contaminated with microorganism is inputted inside of the vessel body, the whole mascara pigments may be contaminated. The use of thusly contaminated mascara pigment may cause a predetermined trouble, for example, a stimulation to eyes, an itchy phenomenon near eyes, etc.

DOCUMENTS OF RELATED ART

Patent Documents (Patent Document 1) Korean Patent No. 10-1289533 {Jul. 24, 2013}; and (Patent Document 2) Korean Patent No. 10-1386308 {Apr. 17, 2014}

SUMMARY OF THE INVENTION

Accordingly, the present invention has been made keeping in mind the above problems occurring in the related art, and the present invention is intended to propose a mascara vessel having a door function that is configured such that when a brush integrated with a cap is pulled out of the vessel body while passing through a packing, mascara that covers the brush is evenly wiped with the packing to remove excess mascara and thereby the present invention can provide the brush evenly covered with mascara to a user.

The present invention is also intended to propose a mascara vessel having a door function which can improve the wiping efficiency for the brush that is wiped with a packing.

Moreover, it is another object of the present invention to provide a mascara vessel which contains a silver glass antibiotic component to inhibit the growth of any microorganism due to the microorganism contamination of a mascara pigment.

In order to achieve the above object, according to the present invention, there is provided a mascara vessel having a door function, the mascara vessel including: a vessel body containing mascara and an antibiotic component therein; a packing set in the vessel body and having an antibiotic component; a door hinged to the packing and functioning to close a passage of the packing and having an antibiotic component; an elastic member provided on a hinge joint between the packing and the door, with opposite ends of the elastic member being held by the packing and the door, respectively, so that the elastic member elastically biases the door in a direction toward the packing; and a depression resisting means provided on an upper surface of the door and functioning to prevent the brush from being depressed by the door when the brush is pulled out of the vessel body.

The depression resisting means may be a rib that protrudes upward from the upper surface of the door.

The rib may have a triangular shape.

The packing may comprise an outside packing and an inside packing, with a taper passage defined in the packing, in which a diameter of the passage is gradually reduced in a downward direction from a top end of the passage, thereby forming a taper shape of the passage.

In the mascara vessel, a gap may be defined between lower parts of the outside packing and the inside packing.

Moreover, in the mascara vessel, a packing, a door, a brush bar and a brush according to the present invention, the antibiotic component is a silver glass containing 1~3% by weight of a silver, and 0.1~3% by weight thereof is contained in the mascara, the vessel, the packing, the door, the brush bar and the brush.

As described above, the mascara vessel according to the present invention is configured such that the depression resisting means is provided on the door hinged to the packing set in the upper part of the vessel body containing mascara therein, so that when the brush integrated with the cap is pulled out of the vessel body while passing through the packing, mascara that covers the brush is evenly wiped with the packing to remove excess mascara and thereby the present invention can provide the brush evenly covered with mascara to a user.

Further, in the mascara vessel according to the present invention, the taper passage is defined in the packing in which the diameter of the passage is gradually reduced in the downward direction from the top end of the passage, thereby forming the taper shape of the passage. In addition, the packing includes the outside packing and the inside packing, with a gap defined between the lower parts of the outside packing and the inside packing, thereby improving the wiping efficiency for the brush that is wiped with the packing.

Moreover, the mascara vessel, the packing, the door, the brush bar and the brush contain an antibiotic component, thus inhibiting the growth of any microorganism.

BRIEF DESCRIPTION OF THE VIEWS OF THE DRAWINGS

The above and other objects, features and other advantages of the present invention will be more clearly understood from the following detailed description when taken in conjunction with the accompanying drawings, in which.

DESCRIPTION OF SPECIFIC EMBODIMENTS OF THE INVENTION

Hereinbelow, an exemplary embodiment of the present invention will be described in detail with reference to the accompanying drawings.

Figure 1:
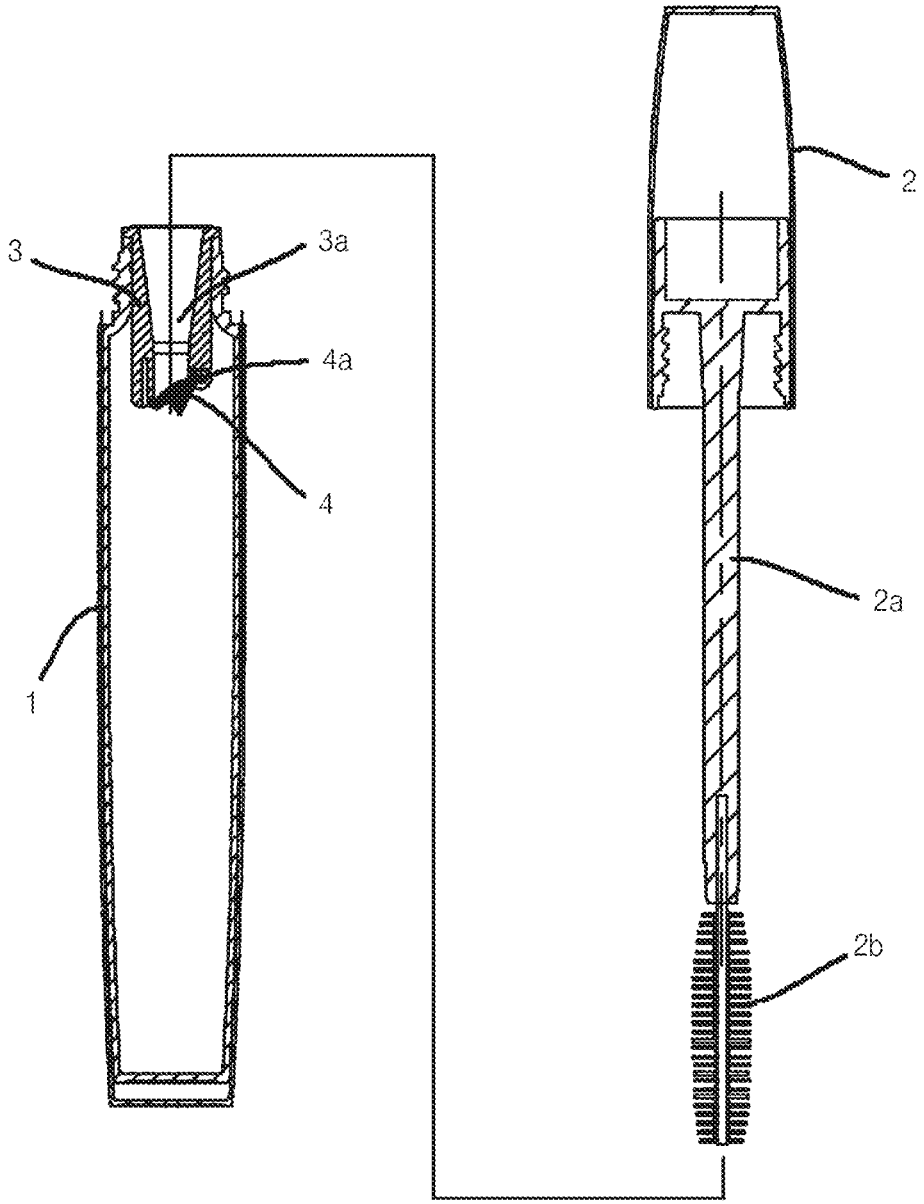
FIG. 1 is an exploded sectional view of an example of conventional mascara vessels.
Figure 2:
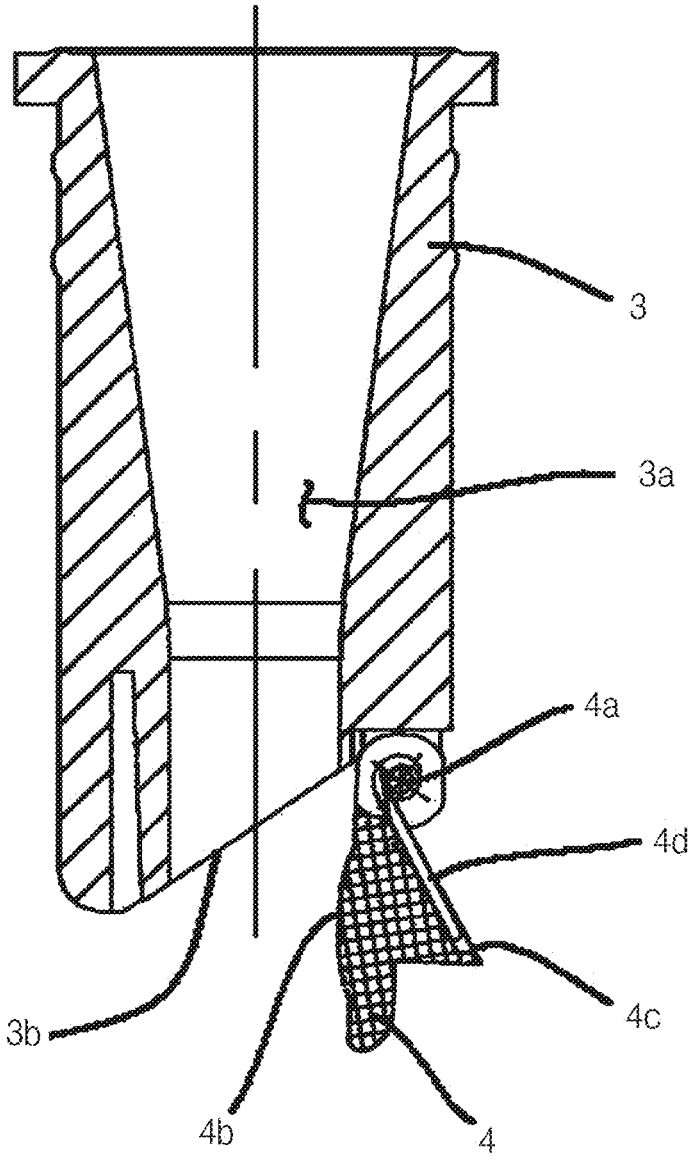
FIG. 2 is a sectional view illustrating a packing of the conventional mascara vessel in detail.
Figure 3:
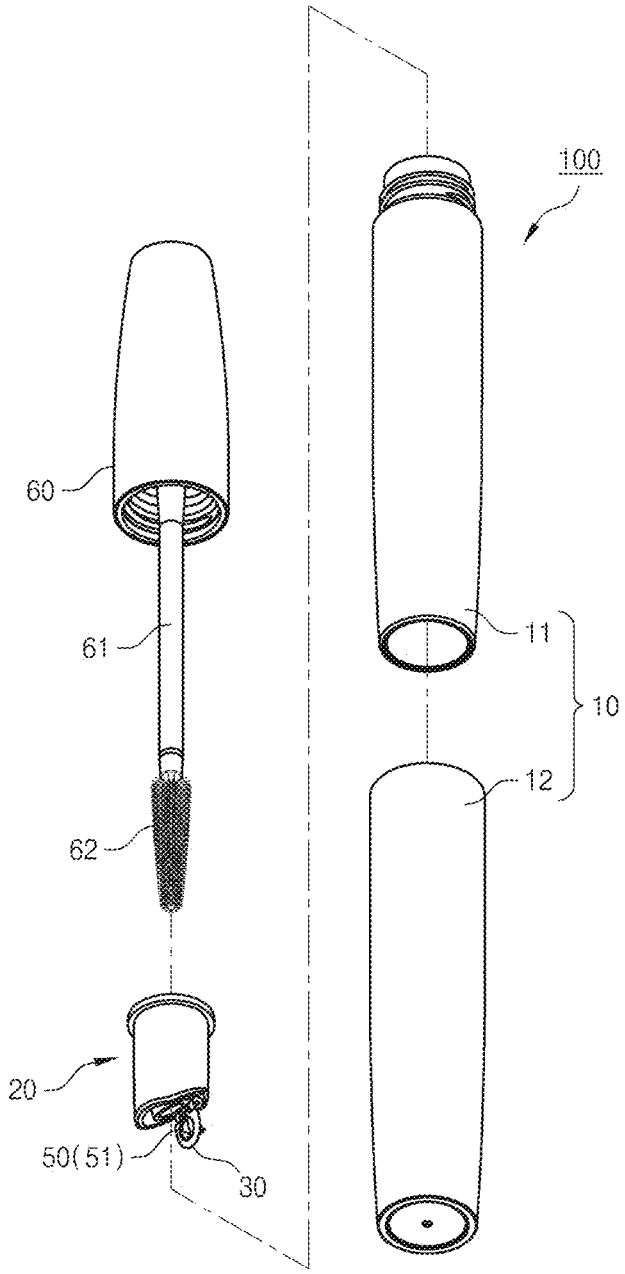
FIG. 3 is an exploded perspective view of a mascara vessel according to the present invention.
Figure 4:
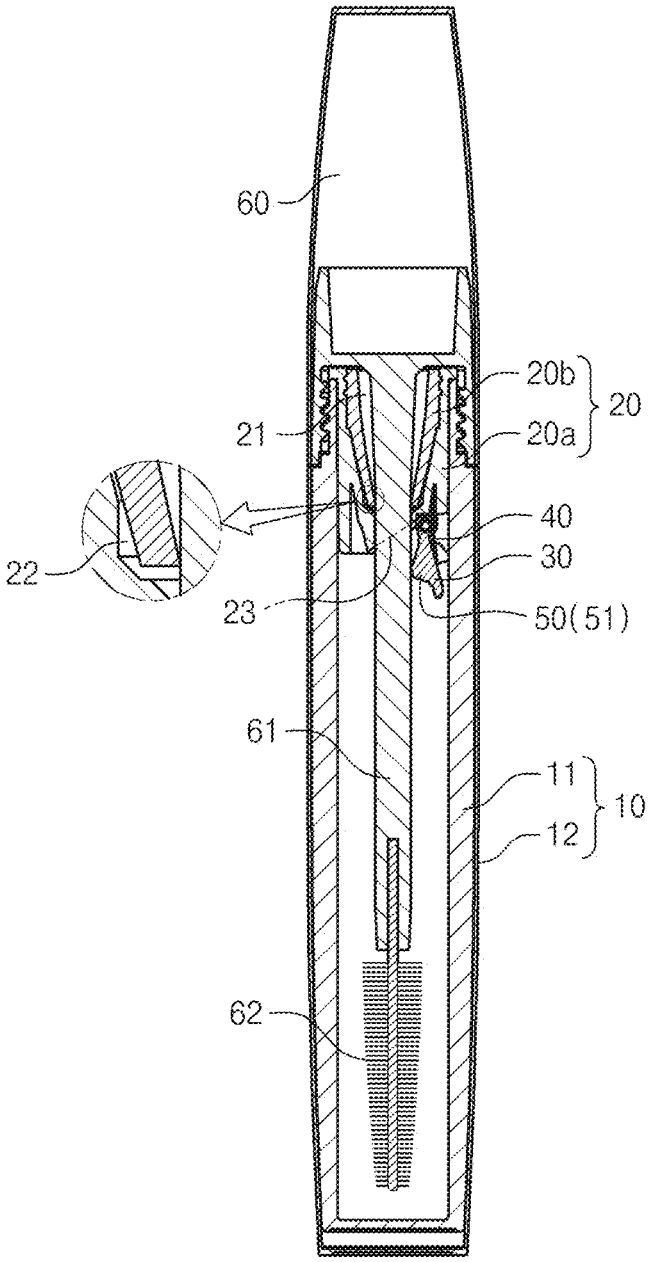
FIG. 4 is a sectional view of the mascara vessel according to the present invention.
Figure 5:
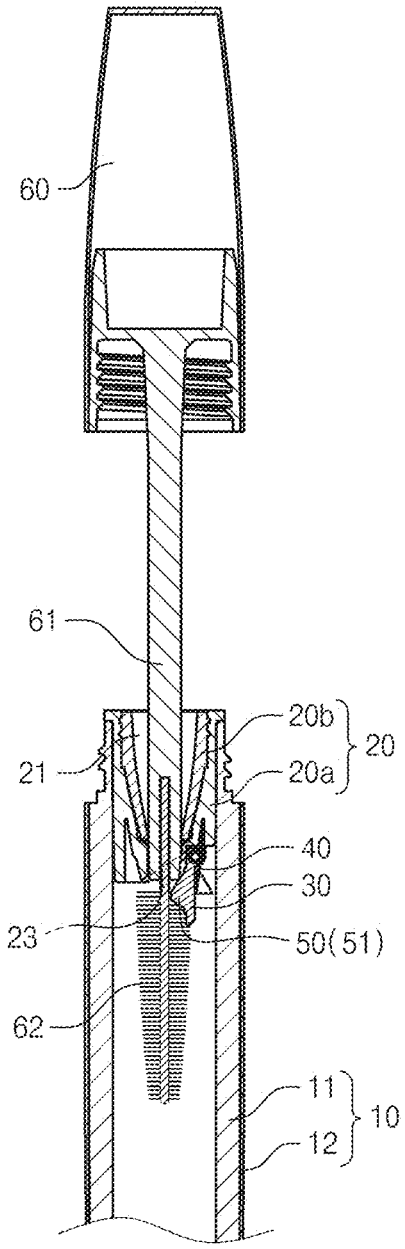
FIG. 5 is a sectional view of the mascara vessel according to the present invention which shows a state before a brush is pulled out from a vessel body.
Figure 6:
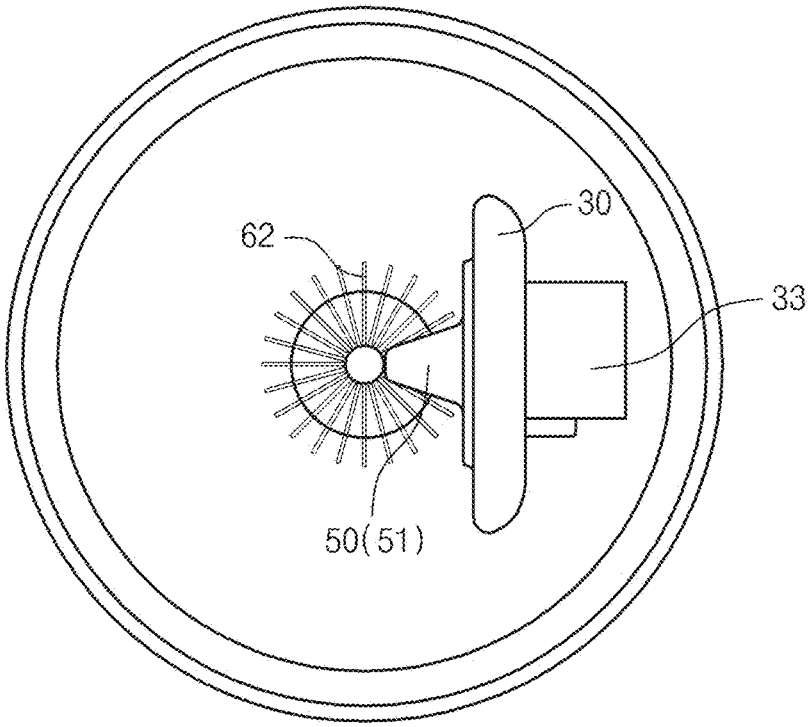
FIG. 6 is a plan sectional view showing the brush and a depression resisting means of the mascara vessel according to the present invention.
Figure 7:
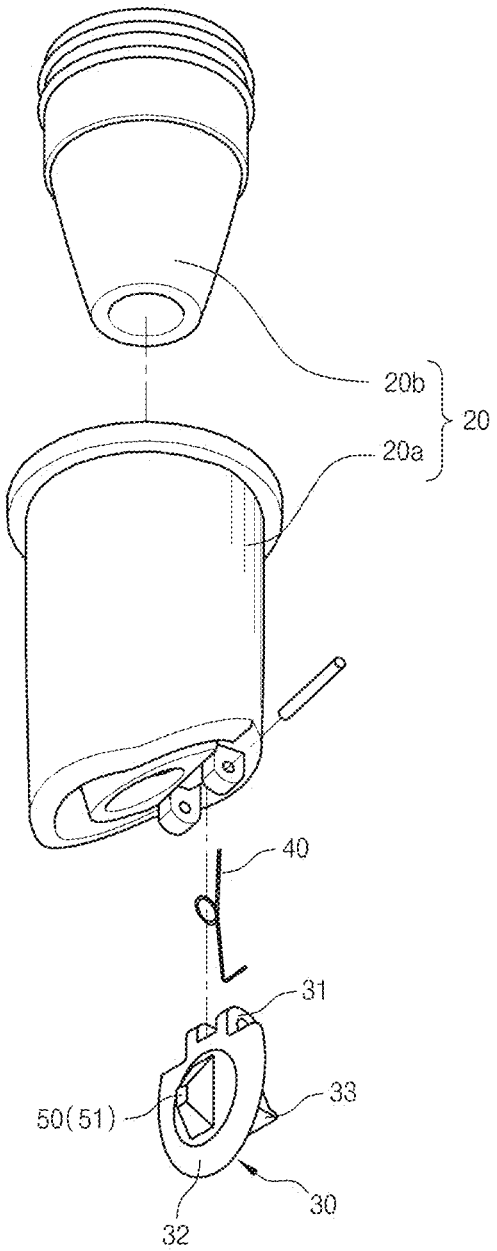
FIG. 7 is an exploded perspective view showing the packing, a door, and the depression resisting means of the mascara vessel according to the present invention.
Figure 8:
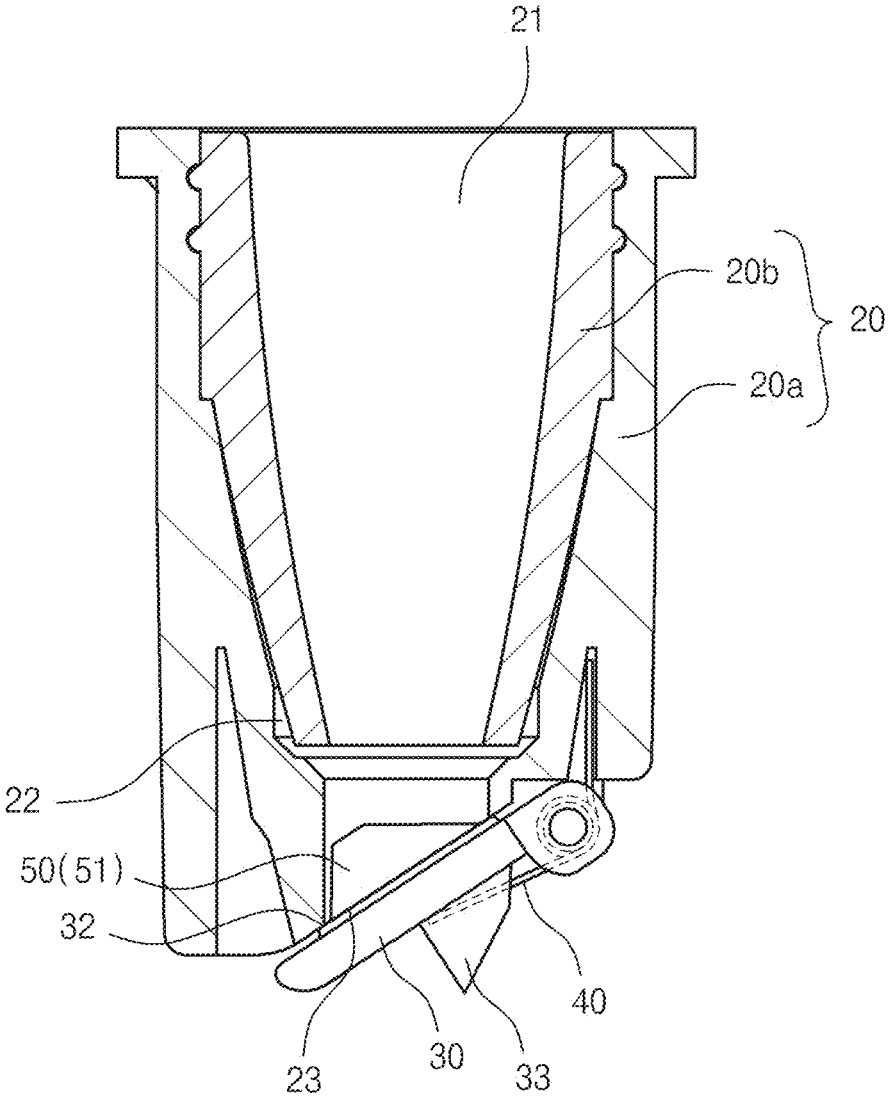
FIG. 8 is sectional view showing the packing, the door in a closed state, and the depression resisting means of the mascara vessel according to the present invention.
Figure 9:
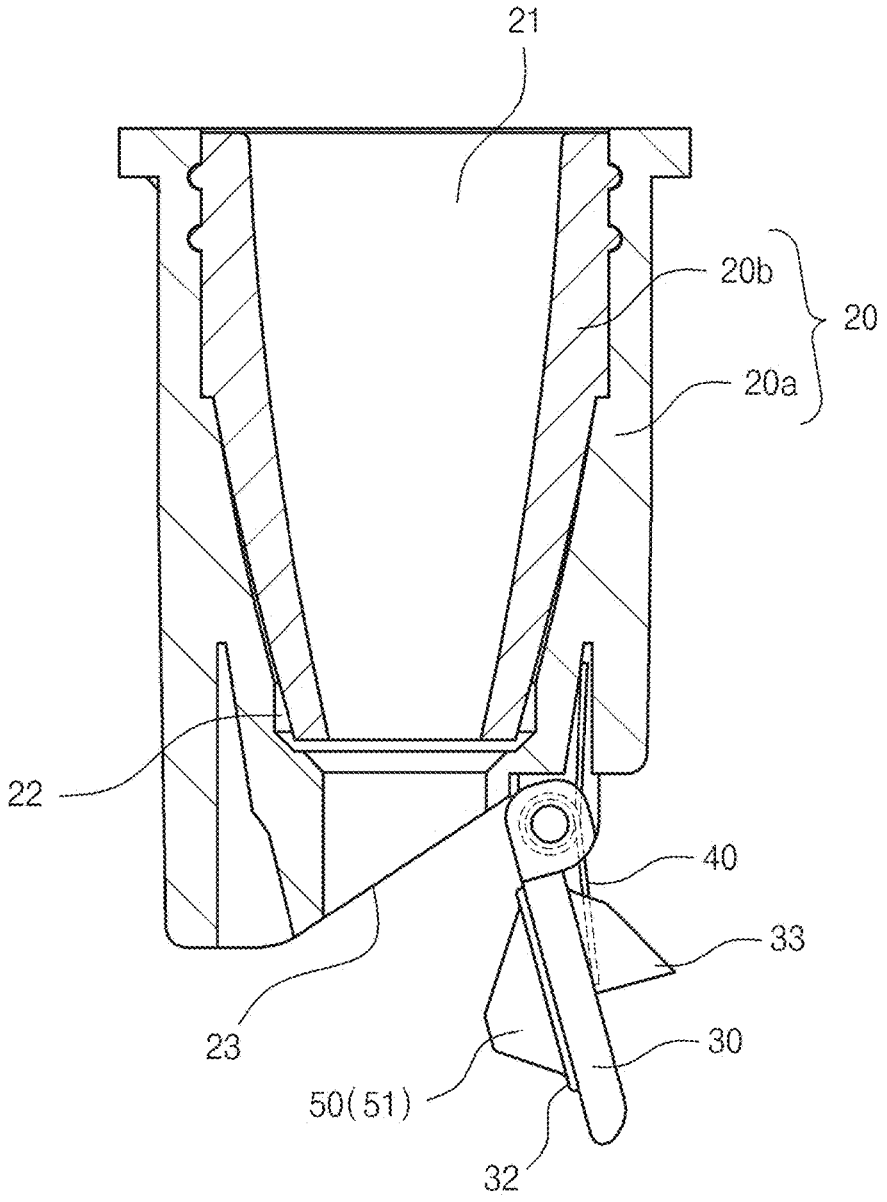
FIG. 9 is sectional view showing the packing, the door in an open state, and the depression resisting means of the mascara vessel according to the present invention.

FIG. 3 is an exploded perspective view of a mascara vessel according to the present invention. FIG. 4 is a sectional view of the mascara vessel according to the present invention. FIG. 5 is a sectional view of the mascara vessel according to the present invention which shows a state before a brush is pulled out from a vessel body. FIG. 6 is a plan sectional view showing the brush and a depression resisting means of the mascara vessel according to the present invention. FIG. 7 is an exploded perspective view showing the packing, a door, and the depression resisting means of the mascara vessel according to the present invention. FIG. 8 is sectional view showing the packing, the door in a closed state, and the depression resisting means of the mascara vessel according to the present invention. FIG. 9 is sectional view showing the packing, the door in an open state, and the depression resisting means of the mascara vessel according to the present invention.

As shown in FIGS. 3, 4, 5, 6, 7, 8 and 9, the mascara vessel 100 according to the present invention includes: a vessel body 10, a packing 20, a door 30, an elastic member 40, a depression resisting means 50, and a cap 60.

Here, the vessel body 10 contains a predetermined amount of mascara therein, in which only the top end of the vessel body 10 is open.

Here, as shown in FIG. 3, the vessel body 10 has a double vessel structure that is formed by an inner casing 11 containing mascara therein and an outer casing 12 receiving the inner casing 11 therein.

The packing 20 is set in the mouth of the vessel body 10, with a taper passage 21 defined in the packing 20. Here, the diameter of the passage 21 is gradually reduced in a downward direction from the top end of the passage 21, thereby forming the taper shape of the passage 21. The packing 20 includes an outside packing **20*a* and an inside packing 20*b***.

Further, a gap 22 is defined between the lower parts of the outside packing **20*a* and the inside packing 20*b* so that the lower end of the inside packing 20*b* can elastically expand toward the outside packing 20*a* due to the presence of the gap 22, thereby efficiently wiping the excess mascara that covers both the brush 62 and the brush bar 61**.

In other words, unlike the conventional technique in which the packing is formed as an integral body so that it is very difficult to form the passage of the packing in a structure capable of efficiently wiping mascara due to a structural limit of a mold for the packing, the present invention divides the packing into the outside packing 20*a* and the inside packing 20*b* in which the inside packing 20*b* is configured as a structure capable of efficiently wiping mascara and the outside packing 20*a* is configured as a structure surrounding the inside packing 20*b*.

Further, the lower surface of the outside packing 20*a* may be configured as a flat surface or an inclined surface having an angle of inclination of 45°. In the present embodiment, the lower surface of the outside packing 20*a* is configured as an inclined surface 23, as an example. The door 30 that will be described later herein is rotatably hinged to the inclined surface 23 such that the door 30 can open or close the passage 21 of the packing 20 by being rotated on the inclined surface 23 of the outside packing 20*a*.

The door 30 is hinged to the packing 20 so as to open or close the passage 21 of the packing 20. To rotatably hinge an end of the door 30 to the inclined surface 23 of the packing 20, a hinge joint 31 is provided on a junction between the end of the door 30 and an associated end of the packing 20, with an elastic member 40 engaged with the hinge joint 31 such that the elastic member 40 elastically biases the door 30 in a direction toward the inclined surface 23 of the packing 20.

Further, to increase the sealing effect between the door 30 and the packing 20, an insert protrusion 32 protrudes on the upper surface of the door 30. The insert protrusion 32 of the door 30 is inserted into the passage 21 through the inclined surface 23 formed on the lower surface of the packing 20 so that the insert protrusion 32 is efficiently engaged with the passage 21 of the packing 20. In other words, when the door 30 comes into contact with the inclined surface 23 of the packing 20, the insert protrusion 32 of the door 30 is inserted into the passage 21 of the packing 20 from the lower surface of the packing 20, thereby realizing excellent sealing effect between the door 30 and the packing 20.

Further, another protrusion 33 protrudes on the lower surface of the door 30 that is opposite to the insert protrusion 32. Here, one end of the elastic member 40 is held by the protrusion 33 so that when the door 30 having the protrusion 33 on the lower surface thereof is opened, the rotated angle of the elastic member 40 that is the opened angle of the door 30 is minimized to an angle less than 60°. Accordingly, the present invention can increase the expected life span of the elastic member 40, thereby improving the durability of the mascara vessel.

The elastic member 40 is installed on the hinge joint 31 provided at the junction between the packing 20 and the door 30. Here, opposite ends of the elastic member 40 are held by the packing 20 and the door 30, respectively, so that the elastic member 40 elastically biases the door 30 in a direction toward the packing 20.

Although the elastic member 40 of the present invention may be freely selected from various elements having elasticity capable of biasing the door 30 in a direction toward the inclined surface 23 of the packing 20, it is preferred to use a torsion spring as the elastic member 40 because the torsion spring is an element that can realize easy installation on the junction and efficient operation. Accordingly, when no external force is applied to the door 30, the door 30 normally elastically maintains a closed state in which the door 30 is in close contact with the inclined surface 23 of the packing 20 due to the elasticity of the elastic member. Because the door 30 normally elastically closes the passage 21 of the packing 20 as described above, the door 30 can prevent the mascara contained in the vessel body 10 from contact with air.

Here, a first end of the elastic member 40 is held by the protrusion 33 of the door 30 and a second end of the elastic member 40 is held by the packing 20 so that the elastic force of the elastic member 40 that is applied to the door 30 acts as a rotating force that rotates the door 30 in a direction to the lower surface of the packing 20. Thus, when the cap 60 is pulled out of the vessel body 10 so as to be removed therefrom, the door 30 is elastically rotated due to the elasticity of the elastic member 40 and closes the passage 21 of the packing 20 just after the brush 62 of the cap 60 is inserted into the passage 21 of the packing 20. On the contrary, when the cap 60 is combined with the vessel body 10, the brush 62 and the brush bar 61 are inserted into the vessel body 10 via the passage 21 of the packing 20. In this case, the brush 62 and the brush bar 61 forcibly rotate the door 30 in a counterclockwise direction while overcoming the elasticity of the elastic member 40, and the brush bar 61 maintains the open state of the door 30.

The depression resisting means 50 is provided on the upper surface of the door 30 and functions to prevent the brush 62 from being depressed by the door 30 when the brush 62 is pulled out of the vessel body 10. Here, in the present invention, the depression resisting means 50 may be configured as a rib 51 that protrudes upward from the upper surface of the door 30 such that when the door 30 is closed, the rib 51 can be inserted into the inclined surface 23 of the packing 20.

In the present invention, the rib 51 may be configured to have a square shape, a circular shape or a triangular shape.

The cap 60 is openably tightened to the mouth of the vessel body 10 in which the packing 20 is set. The cap 60 includes: the brush bar 61 integrated with an end of the cap 60; and the brush 62 that is provided on a lower end of the brush bar 61 and is covered with mascara contained in the vessel body 10.

Further, an O-ring (not shown) may be provided in the junction between the vessel body 10 and the cap 60 so as to seal the junction.

Hereinbelow, the operation of the mascara vessel according to the present invention having the above-mentioned construction will be described.

First, when it is desired to keep the mascara vessel in storage after using the mascara vessel, the cap 60 is tightened to the vessel body 10. When tightening the cap 60 to the vessel body 10, the brush bar 61 and the brush 62 of the cap 60 are inserted into the vessel body 10 through the passage 21 of the packing 20, as shown in FIG. 4. When the brush 62 and the brush bar 61 are inserted into the vessel body 10 as described above, the brush 62 and the brush bar 61 forcibly rotate the door 30 in the counterclockwise direction from a contact position, at which the door 30 is in contact with the inclined surface 23 of the packing 20, while overcoming the elasticity of the elastic member 40, and the brush bar 61 maintains the open state of the door 30.

When it is desired to apply mascara to eyelashes using the mascara vessel, the cap 60 is removed from the vessel body 10. When removing the cap 60 from the vessel body 10, the brush bar 61 having the brush 62 is pulled out of the vessel body 10 along with the cap 60. In this case, just after the brush 62 provided on the lower end of the brush bar 61 enters into the passage 21 of the packing 20, the door 30 is elastically rotated clockwise due to the elasticity of the elastic member 40 and comes into contact with the inclined surface 23 of the lower end of the packing 20, and the insert protrusion 32 provided on the upper surface of the door 30 is inserted into the passage 21 via the opening of the inclined surface 23 of the packing 20, thereby closing the passage 21 of the packing 20.

When the brush bar 61 and the brush 62 pass through the packing 20, the mascara on the brush 62 is evenly wiped with the packing 20 to remove excess mascara so that a user can use the brush 62 evenly covered with the mascara on the outer circumferential surface thereof. During the above-mentioned mascara wiping process, the rib 51 functioning as the depression resisting means 50 can efficiently prevent the brush 62 from being depressed by the door 30.

Further, when the brush bar 61 and the brush 62 pass through the packing 20, the brush bar 61 and the brush 62 can be elastically deformed due to the gap 22 defined between the lower parts of the outside packing 20*a* and the inside packing 20*b* that wipe the mascara, so that the present invention improve the wiping efficiency for the brush 62 that is wiped with the packing 20.

Accordingly, the mascara vessel 100 according to the present invention is advantageous in that when applying mascara to the eyelashes using the mascara vessel or when keeping the mascara vessel in storage while not using the mascara, the door 30 provided on the lower surface of the packing 20 can efficiently close the vessel body 10, so that the present invention can efficiently prevent the mascara contained in the vessel body 10 from being brought into contact with air, thereby efficiently preventing vaporization, hardening, and degradation of the mascara.

The antimicrobial activity of the mascara vessel according to the present invention will be described.

Since the mascara vessel contacting with the mascara pigment contains a predetermined antibiotic component during the injection, it is possible to inhibit the growth of any microorganism in the mascara pigment contacting with the mascara vessel. At least one or more of the other components, except for the mascara vessel, for example, a packing, a door, a brush bar, a brush, etc. may contain an antibiotic component, if necessary.

The antibiotic component may be a silver glass (CAS No 65997-17-3) containing 1~3% by weight of a silver. For example, the silver glass containing 1.8% by weight of a silver may be used. If the silver glass is used, it is possible to effectively provide the mascara vessel with an antimicrobial activity.

In case of the mascara vessel, it may contain 0.1~3% by weight of a silver glass. If the amount of the antibiotic component is too small, an enough antimicrobial activity can't be obtained. If the amount thereof is too much, other physical properties may be degraded. For example, in case of the mascara vessel, it may consist of 80% by weight of a raw material, and 20% by weight of an antibiotic master batch, wherein the antibiotic master batch may consist of 90% by weight of a raw material, and 10% by weight of a silver glass, and the silver glass may contain 1.8% by weight of a silver. As another example, in case of the mascara vessel, it may consist of 99% by weight of a raw material, and 1% by weight of a silver glass. Here, the silver glass may contain 1.8% by weight of a silver. In the aforementioned contents range, higher than 99.99% of the antimicrobial activity with respect to a *staphylococcus* and 100% of the antimicrobial activity with respect to a colon bacterium can be obtained.

Figure 10:
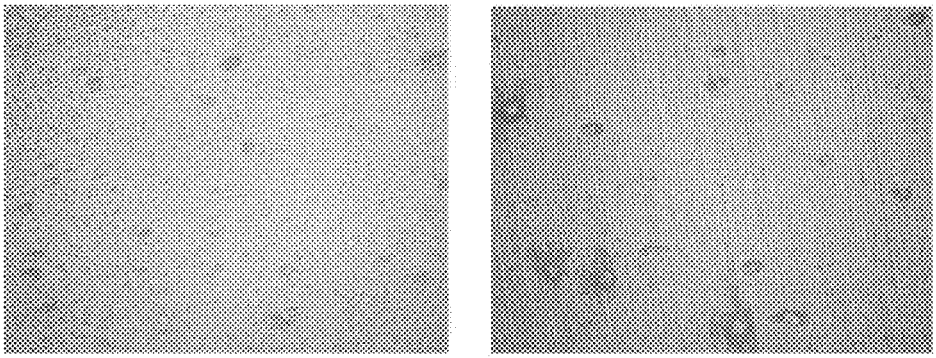
FIG. 10 is a photo taken by an electron microscope and showing a mascara vessel containing a silver glass antibiotic substance.
Figure 11:
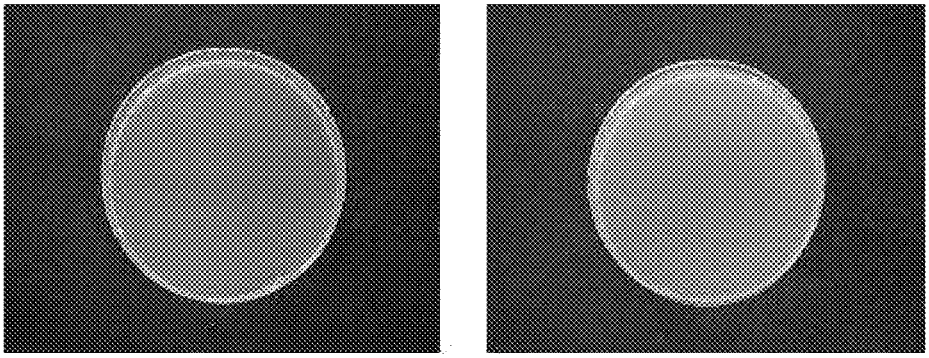
FIG. 11 is a photo showing a result of an antibiotic test on an antibiotic treated sample or a non-treated sample with respect to a *staphylococcus*.
Figure 12:
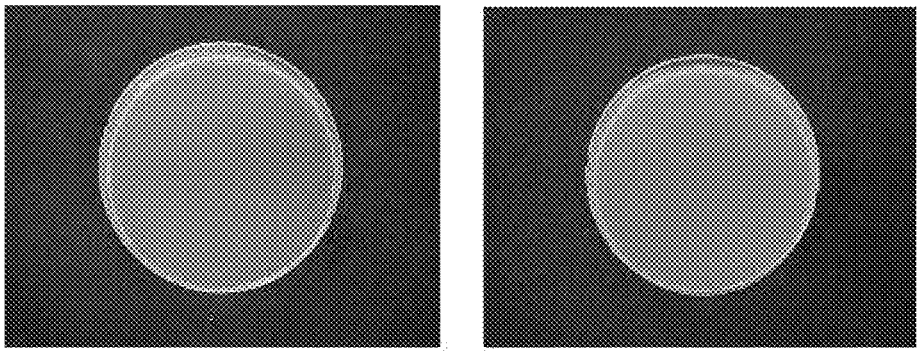
FIG. 12 is a photo showing a result of an antibiotic test on an antibiotic treated sample or a non-treated sample with respect to a colon bacterium.

Table 1 shows a result of the antibiotic tests of the mascara vessel carried out based on the JIS Z2801 2010 antibiotic treated product-antibiosis test method and the test method of the antibiotic effect recited in claim 5. FIG. 10 is a photo taken by an electron microscope and showing a mascara vessel containing a silver glass antibiotic substance, FIG. 11 is a photo showing a result of an antibiotic test on an antibiotic treated sample or a non-treated sample with respect to a staphylococcus, and FIG. 12 is a photo showing a result of an antibiotic test on an antibiotic treated sample or a non-treated sample with respect to a colon bacterium.

TABLE 1

| Strain | Sample name | Initial number of bacteria | After 24 hours | Reduction ratio (%) |
|---|---|---|---|---|
| *S. aureus* (*staphylococcus*) | Antibiotic treated | $1.3 \times 10^4$ | <0.63 | 99.994% |
| | Control | | $1.8 \times 10^4$ | |
| *E. coil* (colon bacterium) | Antibiotic treated | $8.5 \times 10^3$ | <0.63 | 100.000% |
| | Control | | $1.8 \times 10^6$ | |

Although a preferred embodiment of the present invention has been described for illustrative purposes, those skilled in the art will appreciate that various modifications, additions and substitutions are possible, without departing from the scope and spirit of the invention as disclosed in the accompanying claims.

*Description of reference characters of important parts*

| | |
|---|---|
| 100: mascara vessel | 10: vessel body |
| 11: inner casing | 12: outer casing |
| 20: packing | 20a: outside packing |
| 20b: inside packing | 21: passage |
| 22: gap | 23: inclined surface |
| 30: door | 31: hinge joint |
| 32: insert protrusion | 33: protrusion |
| 40: elastic member | 50: depression resisting means |
| 51: rib | 60: cap |
| 61: brush bar | 62: brush |

What is claimed is:

1. A mascara vessel having a door function and an antibiotic component, the mascara vessel comprising:

a vessel body containing mascara therein;

a packing set in the vessel body;

a door hinged to the packing configured to close a passage of the packing;

an elastic member provided on a hinge joint between the packing and the door, with opposite ends of the elastic member being held by the packing and the door, respectively, so that the elastic member elastically biases the door in a direction toward the packing; and a depression resisting member provided on an upper surface of the door and to prevent the brush from being depressed by the door when the brush is pulled out of the vessel body, wherein the depression resisting member comprises a rib that protrudes upward from the upper surface of the door.

2. The mascara vessel of claim 1, wherein the rib has a triangular shape.

3. The mascara vessel of claim 1, wherein the packing comprises an outside packing and an inside packing, with a taper passage defined in the packing, in which a diameter of the passage is gradually reduced in a downward direction from a top end of the passage, thereby forming a taper shape of the passage.

4. The mascara vessel of claim 3, wherein a gap is defined between lower parts of the outside packing and the inside packing.

5. The mascara vessel of claim 1, wherein the antibiotic component is a silver glass containing 1-3% by weight of a silver, and the mascara vessel contains 0.1-3% by weight thereof.

6. The mascara vessel of claim 1, wherein at least one or more of the mascara vessel, the packing set, the door, the brush bar, and the brush contains the antibiotic component.

* * * * *